United States Patent [19]

Järvenkylä et al.

[11] 4,269,435

[45] May 26, 1981

[54] FASTENING MEANS FOR SKIS

[76] Inventors: Juhani Järvenkylä, Lövinginkatu 4,, 04100 Lohja 10; Tapio Yli-Kovero, Metsolankatu 14 D 31, 08150 Lohja 15, both of Finland

[21] Appl. No.: 68,405

[22] Filed: Aug. 21, 1979

[30] Foreign Application Priority Data

Aug. 29, 1978 [FI] Finland ..... 782642

[51] Int. Cl.[3] ..... A63C 11/02

[52] U.S. Cl. ..... 280/814; 211/60 SK; 294/147; 224/917

[58] Field of Search ..... 280/814, 815; 224/45 S, 224/917; 24/81 SK; 211/60 SK

[56] References Cited

U.S. PATENT DOCUMENTS

| | | | |
|---|---|---|---|
| 3,636,739 | 1/1972 | Smedley | 280/814 |
| 3,893,606 | 7/1975 | Hofmann | 280/814 |
| 3,936,067 | 2/1976 | Link | 280/814 |
| 4,190,182 | 2/1980 | Hickey | 224/917 |

FOREIGN PATENT DOCUMENTS

| | | | |
|---|---|---|---|
| 416373 | 7/1925 | Fed. Rep. of Germany | 280/814 |
| 485744 | 3/1976 | U.S.S.R. | 280/814 |

*Primary Examiner*—David M. Mitchell
*Attorney, Agent, or Firm*—Scully, Scott, Murphy & Presser

[57] ABSTRACT

A ski clamp having a frame (1) provided with two adjacent openings (2,3) for a pair of skis. The wall (8) between the openings is broken off, and the outer wall of each opening forms an inwardly directed bow (10), owing to which the same ski clamp can be used for fastening skis of different thicknesses and widths.

1 Claim, 2 Drawing Figures

FASTENING MEANS FOR SKIS

This invention relates to a fastening means for skis comprising a frame of flexible material and provided with two adjacent, substantially parallel openings for a pair of skis.

Such a fastening means is previously known. The disadvantage is that although the frame is made of flexible material, it must still be made relatively rigid in order to produce sufficient clamping forces. For this reason, each fastening means is suitable only for a couple of ski sizes, wherefore skis of a different width and thickness require separate fastening means having openings of different sizes.

From Swiss Patent Specification No. 380 557 is known a fastening means to be connected to the roof rack of a car and provided with a straight horizontal base, two bows extending from the ends of said base in a direction toward each other. The ski is placed on top of the base between the bows having protusions pressing against the upper surface of the ski. Also in this construction, the straight base prevents the use of the means for skis of different widths. If the ski is too narrow, its edges will not touch the bows, and if the ski is too wide, the bows will stand up, in which case the protusions will not engage the ski surface.

The object of the present invention is to provide a fastening means which need be made in one size only suitable for skis of all widths and thicknesses and which, nevertheless, provides a firm hold. This object is achieved by means of construction which is characterized in that the partition wall between the openings is cut off and that the outer wall of the openings in its free state forms at least one inwardly projecting bow extending to the vicinity of the place of the partition wall. Owing to the cut or broken partition wall, the length of the openings may vary within wide limits and, due to the curvature of the outer wall of the openings, also skis of different thicknesses will always fit into the fastening means.

Figure 1:
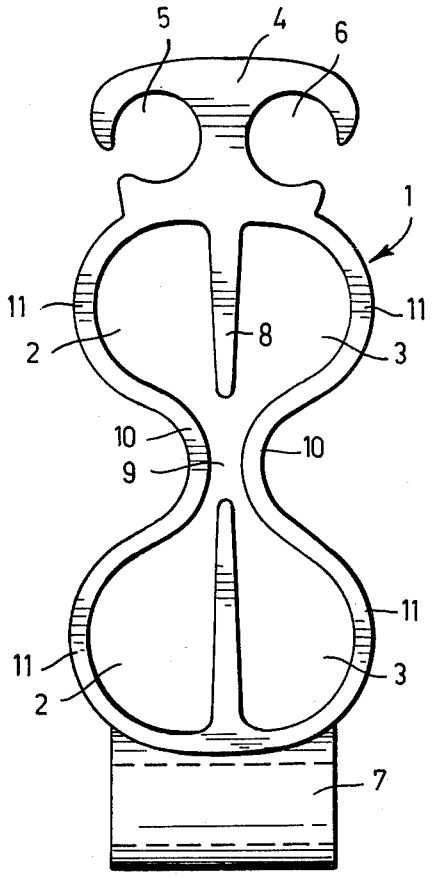
Figure 2:
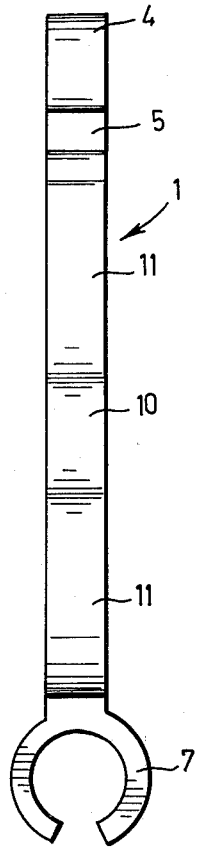

One preferred embodiment of the construction according to the invention will now be described in more detail with reference to the accompanying drawing, in which FIG. 1 is a top view of the fastening means, and FIG. 2 is a side view of the fastening means.

The fastening means shown in the drawing comprises a frame 1, for example, of relatively rigid rubber of plastics. The frame is shaped such that it has two adjoining, parallel openings for a pair of skis. The upper end of the frame is further, when required, provided with a T-shaped projection 4 so that two recesses 5 and 6 for ski sticks are formed between the frame and the projection. In the embodiment according to the Figures, the lower end of the frame is, moreover, provided with a fastening member 7 resembling a split tube and intended for attaching the fastening means, for example, on the tube in an automobile roof rack.

According to the invention, the partition wall 8 between the openings 2 and 3 is cut off to provide an opening 9. Due to the cut partition wall, the length of the openings 2, 3 in the vertical direction may vary considerably, as required. In addition, the outer wall of the openings 2,3 forms in its free state an inwardly projecting bow 10 extending close to the plane of the partition wall 8. Owing to the bow 10, the width of the openings 2,3 in the horizontal direction may vary considerably according to the thickness of the ski.

According to FIG. 1, on both sides of the bow 10, an outwardly projecting bow 11 is provided improving the flexibility of the bow 10.

The number of bow in the outer wall of the openings 2,3 may differ from the above-mentioned number and, accordingly, the number of inwardly directed bows may be, for example, two. The fastening openings 5,6 for ski sticks and the fastening member 7 may be omitted, depending on the use of the fastening means.

What we claim are:

1. A clamp for use in holding a pair of skis, comprising a substantially rectangular closed body formed integrally of a resillient material and including two partition tongues extending towards each other from the middle of the short sides of said body, the partition tongues serving as a partition between each ski of the pair of skis, and both of the long sides of said body having an inherent tendency to assume a configuration of at least two outward bows and, between these, at least one inward bow extending to the vicinity of the plane of the tongues for pressing skis inserted in the openings formed on both sides of said tongues against said tongues, the resilient bows and partition tongues providing for variation of opening length and width according to the dimensions of the skis being clamped.

* * * * *